US008651099B2

(12) United States Patent
Yantis et al.

(10) Patent No.: US 8,651,099 B2
(45) Date of Patent: Feb. 18, 2014

(54) OVEN APPLIANCE WITH A MECHANISM FOR SECURING A PAIR OF DOORS IN A CLOSED CONFIGURATION

(75) Inventors: John Adam Yantis, Louisville, KY (US); Jonathan Michael Cepress, Louisville, KY (US)

(73) Assignee: General Electric Company, Schenectady, NY (US)

( * ) Notice: Subject to any disclaimer, the term of this patent is extended or adjusted under 35 U.S.C. 154(b) by 104 days.

(21) Appl. No.: 13/415,110

(22) Filed: Mar. 8, 2012

(65) Prior Publication Data

US 2013/0233294 A1 Sep. 12, 2013

(51) Int. Cl.
*F24C 15/02* (2006.01)

(52) U.S. Cl.
USPC ..... 126/197; 126/190; 126/192

(58) Field of Classification Search
USPC ..... 126/197, 190, 192, 273 R; 49/324, 340, 49/346, 349; 110/173; 292/34, 35
See application file for complete search history.

(56) References Cited

U.S. PATENT DOCUMENTS

| | | | |
|---|---|---|---|
| 7,735,480 | B2 | 6/2010 | Larsen et al. |
| 7,814,897 | B2 | 10/2010 | Larsen |
| 2007/0246036 | A1 | 10/2007 | Larsen et al. |

*Primary Examiner* — Alfred Basichas
(74) *Attorney, Agent, or Firm* — Dority & Manning, P.A.

(57) ABSTRACT

An oven appliance is provided having a pair of doors mounted to a cabinet of the appliance and configured for permitting selective access to a cooking chamber of the oven appliance. A mechanism selectively secures the pair of doors in a closed configuration such that access to the cooking chamber is impeded by the pair of doors.

18 Claims, 3 Drawing Sheets

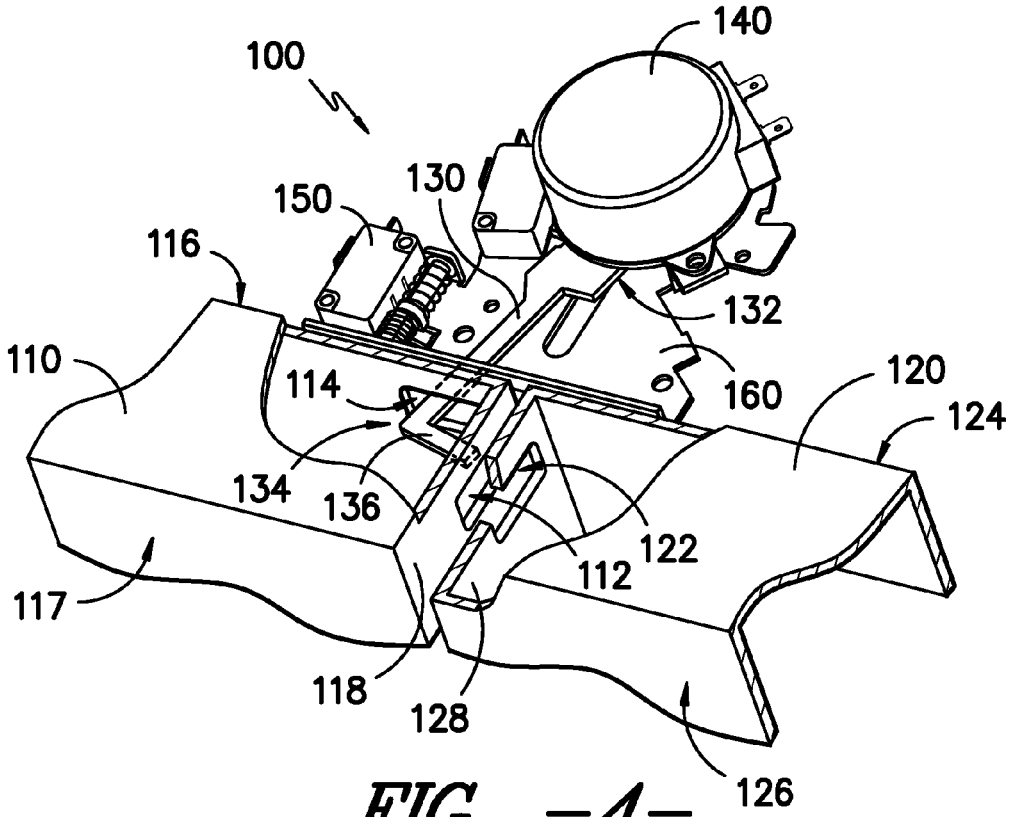
FIG. —4—
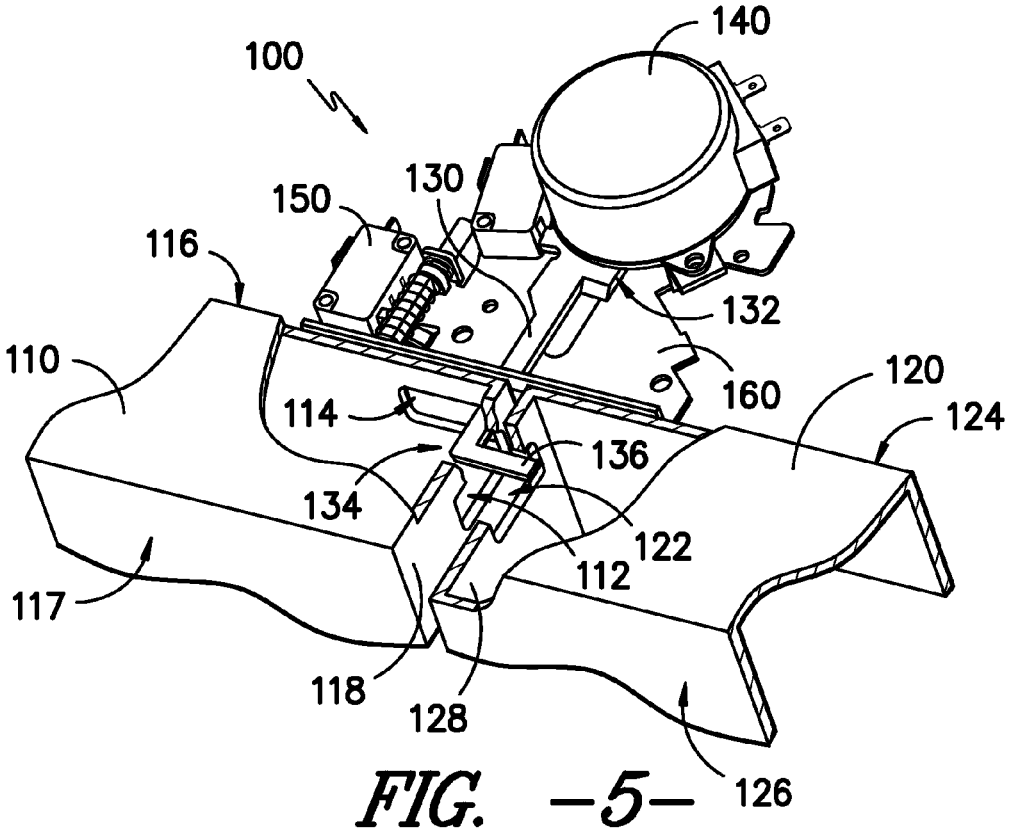
FIG. —5—

OVEN APPLIANCE WITH A MECHANISM FOR SECURING A PAIR OF DOORS IN A CLOSED CONFIGURATION

FIELD OF THE INVENTION

The present subject matter relates generally to oven appliances with a mechanism for selectively securing doors of the appliance in a closed configuration.

BACKGROUND OF THE INVENTION

Certain oven appliances include a cabinet that defines a cooking chamber for receipt of food articles for cooking. A heating element provides heat for cooking the food articles within the cooking chamber. The cabinet also defines an opening for accessing the cooking chamber. Certain oven appliances can also include a pair of doors rotatably mounted to the cabinet adjacent the opening and configured for permitting selective access to the cooking chamber through the opening. Oven appliances having such a pair of doors are generally referred to as French door style oven appliances.

During certain oven cycles, e.g., a cleaning cycle, preferably access to an oven's cooking chamber is restricted. During such oven cycles, the cooking chamber can reach high temperatures. In order to minimize the risk of potential injury, the oven's door(s) are locked in a closed configuration such that a user cannot access the cooking chamber.

Certain French door style oven appliances have a linkage assembly for transferring the motion of one oven door to the other oven door. Thus, a user can open and/or close both of the doors by urging one of the doors open and/or closed respectively. To secure both doors in a closed configuration, certain French door oven appliances secure one of the doors in a closed configuration, e.g., using a latch. With one of the doors secured, the linkage assembly prevents the other door from opening. However, relying upon the linkage assembly to secure both of the doors in the closed configuration can be problematic. For example, a user attempting to open a locked door can place a great amount of stress upon the linkage assembly. Also, the linkage assembly can have an amount of slack that permits the doors to open at least partially and/or slightly in the closed configuration. Accordingly, an oven appliance with features for securing the oven appliance's doors in a closed configuration without relying upon the appliance's linkage assembly would be useful.

In addition, certain French door style oven appliances have a pair of latches. Each of latches is configured for securing a particular one of the pair of doors. However, using a pair of latches to secure an oven's doors in a closed configuration can also be problematic. For example, using a pair of latches can add to the cost and/or complexity of the oven appliance. Additionally, both of the latches must be activated in order to secure both of the oven's doors in the closed configuration. Accordingly, an oven appliance with features for securing the oven appliance's doors in a closed configuration without using a pair of latches would be useful.

BRIEF DESCRIPTION OF THE INVENTION

Aspects and advantages of the invention will be set forth in part in the following description, or may be obvious from the description, or may be learned through practice of the invention.

In a first embodiment, an oven appliance is provided. The oven appliance includes a cabinet defining a chamber for the receipt of food for cooking. The chamber is accessed through an opening defined by the cabinet. A heating element is included for providing heat to the food for cooking in the chamber. A first door and a second door are mounted proximate to the opening. The first and second doors are configured for permitting selective access to the chamber of the cabinet. The first and second doors have an exterior surface spaced apart from an interior surface with a side wall extending between the exterior and interior surfaces. The sidewall of the first door defines a first hole. The sidewall of the second door defines a second hole that is aligned with the first hole of the first door. A latch is configured for selectively securing the first and second doors in a closed configuration. The latch extends through the first hole of the first door and the second hole of the second door in order to secure the first and second doors in the closed configuration.

In a second embodiment, an oven appliance is provided. The oven appliance includes a cabinet that defines a chamber for the receipt of food for cooking. The chamber is accessed through an opening defined by the cabinet. A heating element is included for providing heat to the food for cooking in the chamber. A pair of doors is mounted proximate to the opening. The pair of doors is configured for permitting selective access to the chamber of the cabinet. A latch is configured for selectively securing the pair of doors in a closed configuration. The latch extends longitudinally between a first end and a second end. The first end of the latch is positioned within the cabinet. The second end of the latch extends through each of the pair of doors in order to secure the pair of doors in the closed configuration.

In a third embodiment, an oven appliance is provided. The oven appliance includes a cabinet defining a chamber for the receipt of food for cooking. The chamber is accessed through an opening defined by the cabinet. A heating element is included for providing heat to the food for cooking in the chamber. A first door and a second door are mounted proximate to the opening. The first and second doors are configured for permitting selective access to the chamber of the cabinet. A means for selectively securing the first and second doors in a closed configuration such that access to the chamber of the cabinet through the opening is impeded by the first and second doors is also provided.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 4 and 5 provide front perspective views of the door and lock assembly of FIG. 3 with portions of the doors removed to show details of the lock assembly, and, in particular, FIG. 5 shows the lock assembly securing the doors in the closed configuration while in FIG. 4 the lock assembly does not secure the doors in the closed configuration.

DETAILED DESCRIPTION OF THE INVENTION

Figure 1:
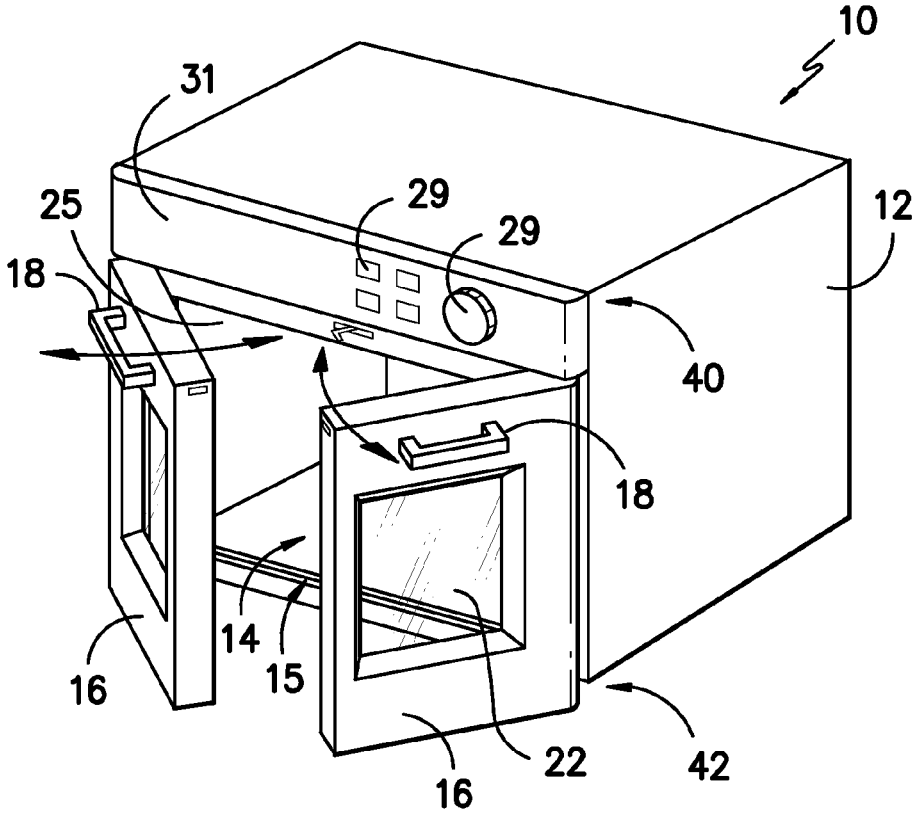
FIG. 1 provides a front perspective view of an exemplary oven appliance according to an embodiment of the present subject matter and, in particular, illustrates a pair of doors of the oven appliance in an open configuration.

An oven appliance is provided having a pair of doors mounted to a cabinet of the appliance and configured for permitting selective access to a cooking chamber of the oven appliance. A mechanism selectively secures the pair of doors in a closed configuration such that access to the cooking chamber is impeded by the pair of doors. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
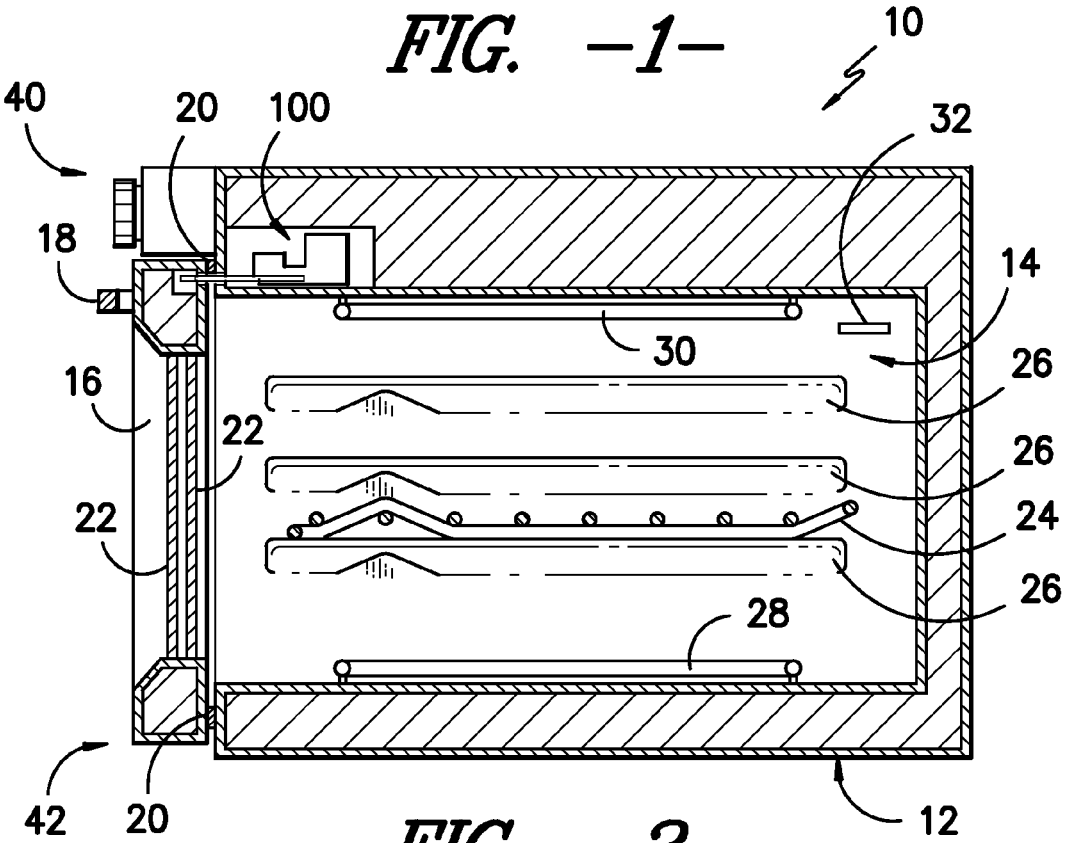
FIG. 2 provides a side cross-sectional view of the oven appliance of FIG. 1 and, in particular, illustrates an exemplary lock assembly securing the doors of the appliance in a closed configuration.

FIGS. 1 and 2 illustrate an exemplary embodiment of an oven appliance 10 of the present invention. Oven 10 includes an insulated cabinet 12 with an interior surface 25 that defines an interior cooking chamber 14. Cooking chamber 14 is configured for the receipt of one or more food items to be cooked. Cabinet 12 extends between a top 40 and a bottom 42. Oven 10 also includes a pair of doors 16, sometimes referred to as "French doors," that are rotatably mounted on cabinet 12 proximate to an opening 15 to chamber 14. Thus, oven 10 is sometimes referred to as a French door style oven appliance. Doors 16 are configured for selectively shifting between an open configuration shown in FIG. 1 in which a user can access cooking chamber 14 and a closed configuration shown in FIG. 2 in which the user is impeded from accessing cooking chamber 14 by doors 16. Handles 18 are attached to doors 16 and allow for opening and/or closing one or both of the doors 16.

One or more seals 20 between doors 16 and cabinet 12 provide for maintaining heat and cooking fumes within chamber 14 when door 16 is closed as shown in FIG. 2. Glass panes 22 provide for viewing the contents of chamber 14 when door 16 is closed as well as providing insulation between chamber 14 and the exterior of oven 10. A rack 24 is positioned in chamber 14 for the receipt of food items. Rack 24 is slidably received onto ribs/rails 26 such that rack 24 may be conveniently moved into and out of chamber 14 when door 16 is open. Multiple rails 26 are provided so that the height of rack may be adjusted.

Heating elements 28 and 30 are positioned within the chamber 14 of cabinet 12. Heating elements 28 and 30 are used to heat chamber 14 for both cooking and cleaning of oven 10. While electrically-resistive heating elements 28 and 30 are shown, the present invention may be used with other heating elements as well such as gas burners or microwave elements.

The operation of oven 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven 10.

Such processing device is also in communication with a temperature sensor 32 that is used to measure temperature inside chamber 14. Although only one temperature sensor 32 is shown, it should be understood that multiple sensors 32 could be placed into oven 10 for determining the oven temperature. As will be understood by one of ordinary skill in the art, the temperature within oven 10 may not be homogeneous during operation and can include regions that are hotter or colder. Accordingly, multiple temperature sensors can be used to more accurately determine oven temperature. In addition, the processing device(s) of oven 10 can be equipped with one on more algorithms for determining oven temperature based on input from multiple temperature sensors.

Oven 10 is provided by way of example only. The present invention may be used with other oven configurations, e.g., an oven range. For example, the present invention may be used with an oven defining multiple interior cavities for the receipt of food and/or having different pan or rack arrangements than what is shown in FIG. 2. Heating elements at the top, back, or sides of chamber 14 may also be provided. Other configurations may also be used as will be understood by one of skill in the art using the teachings disclosed herein. The present invention may also be used with ovens having a variety of different types of heating sources such as microwave, halogen, gas fuel, electrical resistance, and combinations thereof. Doors 16 may also be mounted to cabinet 12 in any other suitable manner or configuration.

As may be seen in FIGS. 1 and 2, oven 10 includes a lock assembly 100. Lock assembly 100 is configured for selectively securing doors 16 in the closed configuration shown in FIG. 2. For example, during a cleaning cycle of oven 10, cooking chamber 14 and heating elements 28, 30 can reach high temperatures. Lock assembly 100 may secure doors 16 in the closed configuration during the cleaning cycle, e.g., in order to prevent the user from accessing the cooking chamber 14.

Figure 3:
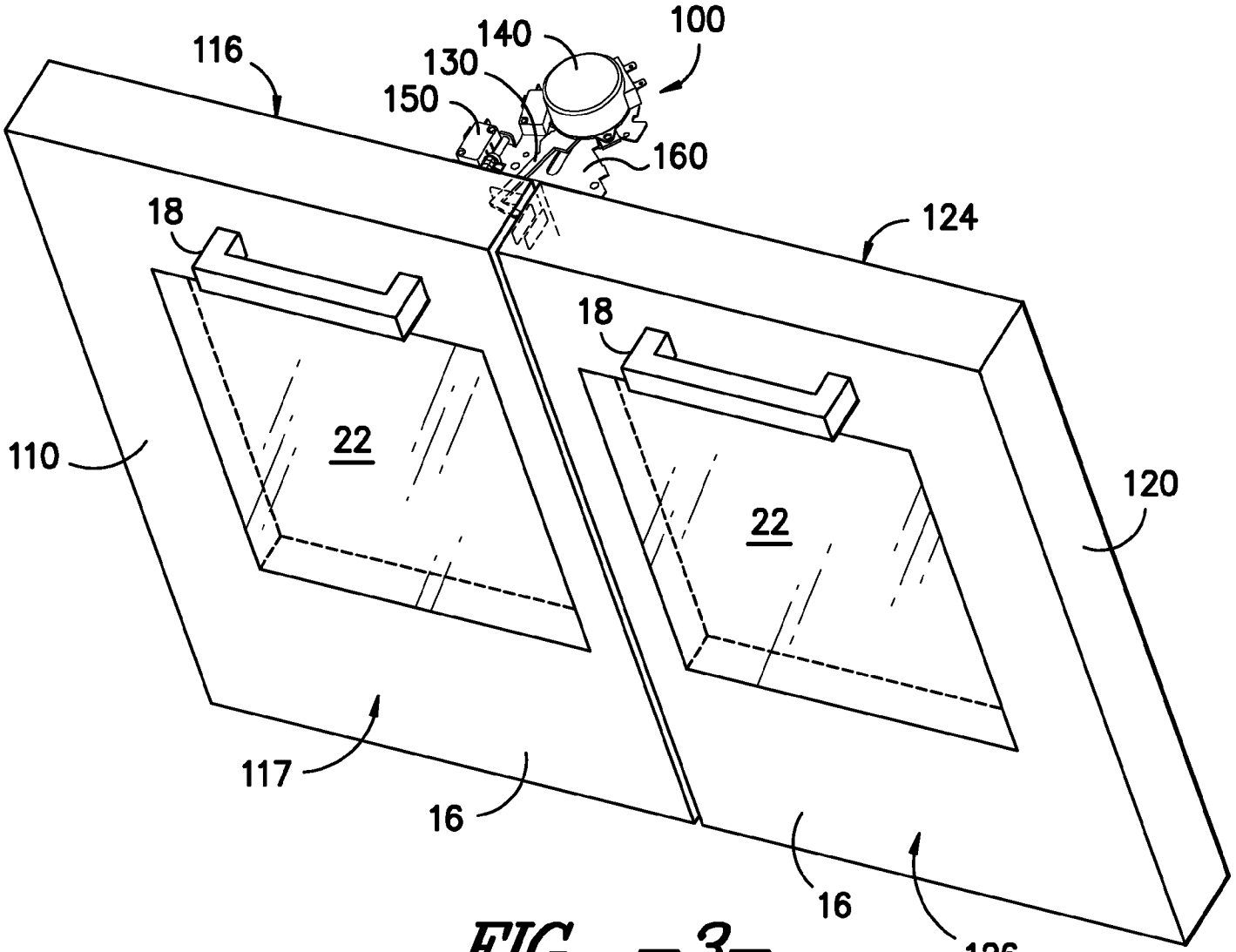
FIG. 3 illustrates a front perspective view of the doors of the appliance of FIG. 2 secured in the closed configuration by the lock assembly.

FIG. 3 illustrates doors 16 and lock assembly 100 removed from oven 10 for clarity. As may be seen in FIG. 3, doors 16 include a first door 110 and a second door 120. Lock assembly 100 includes a latch 130 that is rotatably mounted to a support plate 160 and, as described in greater detail below, selectively extends through first and second doors 110, 120 in order to secure first and second doors 110, 120 in the closed configuration shown in FIG. 3. Lock assembly 100 also includes a motor 140 and a switch 150 mounted to support plate 160. As described in greater detail below, switch 150 is configured for determining when first and second doors 110, 120 are in the closed configuration. When switch 150 determines first and second doors 110, 120 are in the closed configuration, motor 140 may selectively extend latch 130 through first and second doors 110, 120. Processing device is in communication with switch 150 and motor 140, e.g., to operate motor 140.

In alternative embodiments, an additional switch (not shown) may be mounted to support plate 160. Additional switch may cooperate with switch 150 to determine when first and second doors 110, 120 are in the closed configuration. For example, additional switch may determine when first door 110 is in the closed configuration and switch 150 may determine when second door 120 in the closed configuration or vice versa.

FIGS. 4 and 5 illustrate lock assembly 100 and portions of first and second doors 110, 120. Portions of first and second doors 110, 120 have been removed to illustrate details of lock assembly 100 and the interaction between lock assembly 100 and first and second doors 110, 120. In FIG. 4, latch 130 of lock assembly 100 does not extend through first and second doors 110, 120 and, thus, does not secure first and second doors 110, 120 in the closed configuration. However, in FIG. 5, latch 130 of lock assembly 100 extends through first and second doors 110, 120 and, thus, secures first and second doors 110, 120 in the closed configuration.

First door 110 has an interior surface 116 and an exterior surface 117. When first door 110 is in the closed configuration interior surface 116 of first door 110 cooperates with interior surface 25 (FIG. 1) of cabinet 12 to form cooking chamber 14 (FIG. 1). Interior surface 116 is spaced apart from exterior surface 117, and a sidewall 118 extends between interior surface 116 and exterior surface 117. Sidewall 118 of first door 110 defines a first hole 112. As may be seen in FIG. 5, latch 130 may extend through first hole 112 in order to secure first door 110 in the closed configuration. First door 110 also defines an access hole 114. As discussed in greater detail below, access hole 114 permits latch 130 to extend through first and second doors 110, 120.

Second door 120 also has an interior surface 124 and an exterior surface 126. When second door 120 is in the closed configuration interior surface 124 of second door 120 cooperates with interior surface 25 (FIG. 1) of cabinet 12 to form cooking chamber 14 (FIG. 1). Interior surface 124 of second door 120 is spaced apart from exterior surface 126 of exterior door 120, and a sidewall 128 extends between interior surface 124 and exterior surface 126 of exterior door 120. Sidewall 128 of second door 120 defines a second hole 122. As may be seen in FIG. 5, latch 130 may extend through second hole 122 in order to secure second door 120 in the closed configuration. Second hole 122 has a similar shape to first hole 112 and is aligned with first hole 112 in the closed configuration (FIG. 2).

Latch 130 extends between a first end 132 and a second end 134. First end 132 of latch 130 is rotatably mounted to support plate 160 and is positioned within cabinet 12 (FIG. 2). First end 132 of latch 130 is in mechanical communication with motor 140 such that motor 140 may selectively rotate latch 130 as described in greater detail below. Second end 134 of latch 130 defines a hook 136. As may be seen in FIGS. 4 and 5, hook 136 may be selectively extended through first hole 112 of first door 110 and second hole 122 of second door 120 in order to secure first and second doors 110, 120 in the closed configuration. Similarly, hook 136 may be selectively retracted from first hole 112 of first door 110 and second hole 122 of second door 120 in order to permit first and second doors 110, 120 to shift between the open and closed configurations.

It should be understood that latch 130 is provided by way of example only. Other suitable latches and configurations may be used as well. For example, rather than defining hook 137, latch 130 may pass into first door 110 and actuate a pin or secondary latch that extends through first hole 112 and/or second hole 122 in order to secure doors 16 in the closed configuration.

As an example, a user may adjust doors 16 from the open configuration shown in FIG. 1 to the closed configuration shown in FIG. 3. In the closed configuration, first hole 112 is positioned adjacent second hole 122 such that first hole 112 is aligned with second hole 122. As doors 16 adjust to the closed configuration, second end 134 of latch 130 and hook 137 enter first door 110 through access hole 112. In addition, when doors 16 are adjusted to the closed configuration, switch 150 is actuated by one of doors 16. With switch 150 activated, motor 140 may shift or urge hook 137 into second door 120 such that hook 137 extends through first door 110 and second door 120 via first hole 112 and second hole 122. With hook 137 extending through first hole 112 and second hole 122, latch 130 secures doors 16 in the closed configuration.

To open doors 16, motor 137 may be activated to shift or urge hook 137 out of first and second holes 112, 122 such that hook 137 is disposed in first door 110. The user may then pull on handles 18 in order to shift doors 16 to the open configuration such that latch 130 is removed from first door 130 through access hole 114. When doors 16 are in the open configuration, switch 150 is de-actuated such that motor 140 is prevented from shifting latch 130. Thus, latch 130 will not shift and impede doors 16 from being closed by the user.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a chamber for the receipt of food for cooking, the chamber accessed through an opening defined by said cabinet;

a heating element for providing heat to the food for cooking in the chamber;

a first door and a second door mounted proximate to the opening, said first and second doors configured for permitting selective access to the chamber of said cabinet, said first and second doors having an exterior surface spaced apart from an interior surface with a side wall extending between the exterior and interior surfaces, the sidewall of said first door defining a first hole, the sidewall of said second door defining a second hole that is aligned with the first hole of said first door when said first door and said second door are in a closed configuration; and a latch configured for selectively securing said first and second doors in the closed configuration, wherein said latch extends longitudinally between a first end and a second end, the first end of said latch positioned within said cabinet such that said latch extends through an access hole defined in the interior surface of said first door, the second end of said latch defining a hook, the hook extending through the first hole of said first door and the second hole of said second door in order to secure said first and second doors in the closed configuration.

2. The appliance of claim 1, wherein the chamber of said cabinet extends between a top and a bottom, said latch positioned adjacent the top of said cabinet.

3. The appliance of claim 1, further comprising a motor in mechanical communication with said latch such that said motor selectively removes said latch from the first and second holes and selectively extends said latch into the first and second holes.

4. The appliance of claim 3, further comprising a switch configured for detecting when said first or second door is in the closed configuration, said switch being in communication with said motor such that said motor is permitted to extend said latch into the first and second holes when said switch detects that said first or second door is in the closed configuration.

5. The appliance of claim 1, wherein the first end of said latch is mounted to a support plate positioned within said cabinet.

6. The appliance of claim 5, further comprising a motor mounted to said support plate and in mechanical communication with the first end of said latch such that said motor selectively removes the hook of said latch from the first and second holes and selectively extends said latch into the first and second holes.

7. The appliance of claim 6, further comprising a switch mounted to said support plate and configured for detecting when said first or second door is in the closed configuration, said switch in communication with said motor such that said motor is permitted to extend said latch into the first and second holes when said switch detects that said first or second door is in the closed configuration.

8. The appliance of claim 1, wherein said first and second doors are urged by said latch towards said cabinet such that said first and second doors are urged against a gasket that is positioned adjacent the opening of said cabinet and configured for limiting loss of heat from the chamber of said cabinet through the opening.

9. An oven appliance comprising:

a cabinet defining a chamber for the receipt of food for cooking, the chamber accessed through an opening defined by said cabinet;

a heating element for providing heat to the food for cooking in the chamber;

a pair of doors mounted proximate to the opening, said pair of doors configured for permitting selective access to the chamber of said cabinet; and a latch configured for selectively securing said pair of doors in a closed configuration, said latch extending longitudinally between a first end and a second end, the first end of said latch positioned within said cabinet, the second end of said latch defining a hook, the hook of said latch extending through each of said pair of doors in order to secure said pair of doors in the closed configuration.

10. The appliance of claim 9, wherein said pair of doors comprises a first door and a second door, wherein said first and second doors have an exterior surface spaced apart from an interior surface with a side wall extending between the exterior and interior surfaces, the sidewall of said first door defining a first hole, the sidewall of said second door defining a second hole that is aligned with the first hole of said first door, wherein the hook extends through the first hole of said first door and the second hole of said second door in order to secure said first and second doors in the closed configuration.

11. The appliance of claim 10, wherein the first end of said latch is positioned within said cabinet such that said latch extends through an access hole defined in the interior surface of said first door.

12. The appliance of claim 10, wherein said pair of doors is urged by said latch towards said cabinet such that said pair of doors is urged against a gasket that is positioned adjacent the opening of said cabinet and configured for limiting loss of heat from the chamber of said cabinet through the opening.

13. The appliance of claim 10, further comprising a motor in mechanical communication with said latch such that said motor selectively removes said latch from the first and second holes and selectively extends said latch into the first and second holes.

14. The appliance of claim 13, further comprising a switch configured for detecting when said first or second door is in the closed configuration, said switch in communication with said motor such that said motor is permitted to extend said latch into the first and second holes when said switch detects that said first or second door is in the closed configuration.

15. The appliance of claim 10, wherein the first end of said latch is mounted to a support plate positioned within said cabinet such that said latch extends through an access hole defined in the interior surface of said first door.

16. The appliance of claim 15, further comprising a motor mounted to said support plate and in mechanical communication with the first end of said latch such that said motor selectively removes the hook of said latch from the first and second holes and selectively extends said latch into the first and second holes.

17. The appliance of claim 16, further comprising a switch mounted to said support plate and configured for detecting when said first or second door is in the closed configuration, said switch in communication with said motor such that said motor is permitted to extend said latch into the first and second holes when said switch detects that said first or second door is in the closed configuration.

18. The appliance of claim 9, wherein the chamber of said cabinet extends between a top and a bottom, said latch positioned adjacent the top of said cabinet.

* * * * *